US005245771A

United States Patent [19]

Walsh

[11] Patent Number: 5,245,771

[45] Date of Patent: Sep. 21, 1993

[54] TRAILABLE SNOW PLOW FOR OFF ROAD USE

[75] Inventor: Michael R. Walsh, Weathersfield, Vt.

[73] Assignee: The United States of America as represented by the Secretary of the Army, Washington, D.C.

[21] Appl. No.: 925,679

[22] Filed: Aug. 7, 1992

[51] Int. Cl.[5] ..... E01H 5/04

[52] U.S. Cl. ..... 37/269; 37/231; 37/270; 37/272; 280/461.1; 280/492; 172/484

[58] Field of Search ..... 37/231, 266, 267, 268, 37/269, 270, 272, 274; 172/484, 624.5; 280/461.1, 467, 474, 478.1, 486, 492

[56] References Cited

U.S. PATENT DOCUMENTS

| | | | |
|---|---|---|---|
| 3,561,539 | 2/1971 | Evans | 172/484 X |
| 3,755,930 | 9/1973 | Brandt et al. | 37/270 X |
| 4,103,443 | 8/1978 | Pelsy | 172/484 X |
| 4,208,974 | 6/1980 | Dreyer et al. | 172/484 X |
| 4,506,465 | 3/1985 | Johnson | 37/268 |
| 5,050,322 | 9/1991 | Burkard | 37/266 X |

FOREIGN PATENT DOCUMENTS

| | | | |
|---|---|---|---|
| 1029849 | 5/1958 | Fed. Rep. of Germany | 172/484 |

*Primary Examiner*—Randolph A. Reese
*Assistant Examiner*—Arlen L. Olsen
*Attorney, Agent, or Firm*—Luther A. Marsh

[57] ABSTRACT

The disclosure relates to a road transportable, adjustable or non-adjustable width trailable plow which is adapted to be pulled by a tow vehicle, a four bar linkage interconnects the plow with the tow vehicle allowing the plow to yaw with respect to the vehicle while limiting motion in the pitch plane to parallel displacement, the horizontal links in the four bar linkage are telescopic and spring biased to allow for surge between the tow vehicle and the load and a frame portion securable to the tow vehicle is gimballed with the hitch on an axis parallel to the links for allowing the plow to roll with respect to the tow vehicle.

24 Claims, 8 Drawing Sheets

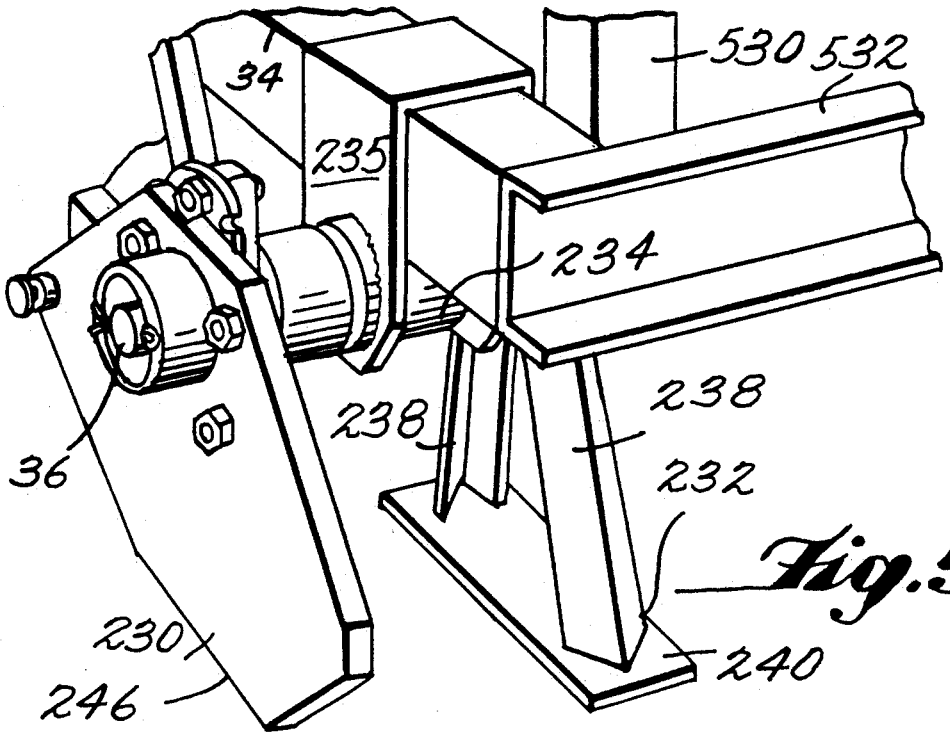
Fig. 5B.
Fig. 9.
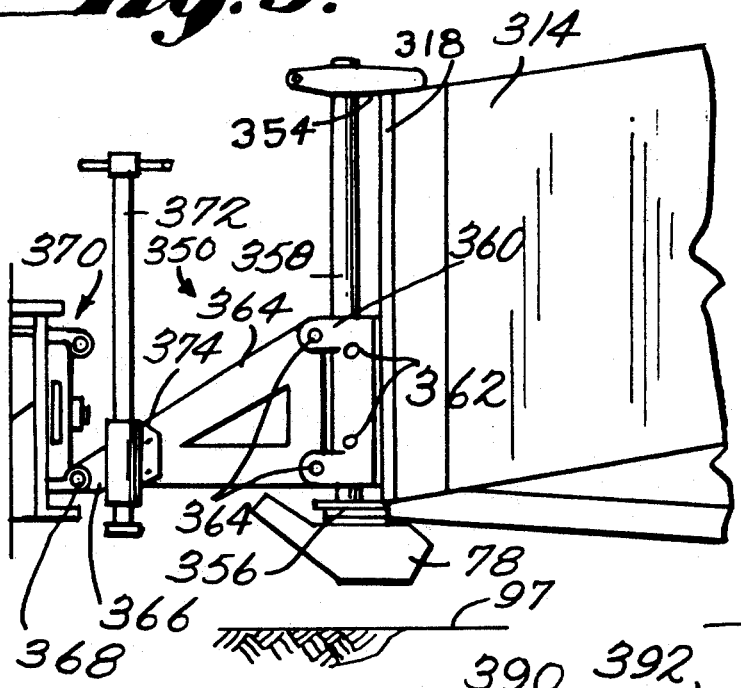
Fig. 10.
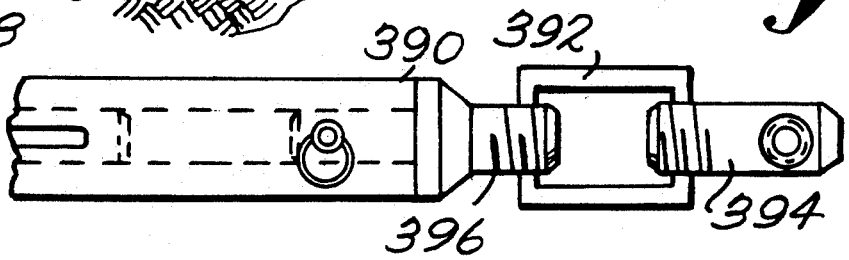

YAW

ROLL

PITCH

SURGE

TRAILABLE SNOW PLOW FOR OFF ROAD USE

BACKGROUND OF THE INVENTION

The invention relates to an apparatus for clearing an off road path in deep snow. In particular, the invention is directed to a trailable snow plow for off road use.

It is necessary for the military to perform maneuvers over different terrains and under various adverse conditions which can be realistically expected. For example, it may be necessary to move wheeled equipment off the road in heavy snow conditions. Thus, some sort of snow removal equipment is necessary.

It is generally undesirable to design new equipment or to modify existing equipment, to perform specialized tasks. It is most desirable to employ devices adapted for use with currently available equipment. For example it is undesirable to have a specialized snow removal vehicle. It is undesirable, but less so, to modify a vehicle to carry a plow on the front of the vehicle. To do this, it is necessary to provide a complicated support and lifting mechanism on the vehicle. For military purposes, this is undesirable and unacceptable. Further, front mounted snow plows are designed primarily for roadways and have a tendency to dig in when they encounter an obstacle. Accordingly, a front mounted plow is unworkable for off-road military purposes.

Most military vehicles have means provided for pulling or trailering specialized heavy equipment without requiring additional equipment or a power take-off. Accordingly, it is desirable to provide a snow plow which may be pulled by a vehicle and thereby provide an adequate path for the equipment which follows.

It is also important to consider that during maneuvers of the kind described, the use of heavy equipment for removing snow in rough terrain can cause adverse environmental effects. For example, in permafrost regions the heavy equipment can damage the upper terrain surface, and the adverse effects may not be realized until the Spring thaw. Thus, ecologically benign equipment is desirable.

It is also important for the equipment to be fairly mobile. Heavy construction equipment which might be effective to remove snow is too slow or may not be available for military deployment purposes. Accordingly, in most cases, off road access for wheeled military vehicles and equipment is not a practical expedient in deep snow during the winter.

SUMMARY OF THE INVENTION

The invention is intended to obviate and eliminate the shortcomings and disadvantages of the described prior arrangements. In particular, the invention is directed to a trailable plow adapted to be towed behind a vehicle. The trailable snow plow comprises a plow blade and a plow hitch secured to the plow blade; a trailer hitch adapted to be secured to the vehicle; and a flexible linkage interconnecting the plow hitch and the trailer hitch. The plow hitch and trailer hitch are rotatable about a common axis. The plow hitch and the trailer hitch are each rotatable about a pair of axes lying in a plane defined by the linkage and the common axis are each movable along its respective corresponding axis.

In one embodiment, the trailable plow comprises a V-plow blade, a plow hitch secured to the apex of the V plow blade for rotatable movement about a first axis. A trailer hitch is securable to the vehicle. Linkage means is secured between the plow hitch and the trailer hitch, the plow hitch and trailer hitch being mounted on corresponding spaced apart longitudinal axes for axial and rotatable motion thereon and for rotation about a common axis transverse of the longitudinal axes. Additional features include ground engaging skids and interchangeable or retractable wheels, and a built in jack. An alternative plow arrangement includes a retractable plow blade and a rack and pinion plow blade retractor.

BRIEF DESCRIPTION OF THE DRAWINGS

FIG. 2 is a side sectional, elevation of a "V" plow assembly in accordance with the present invention;

FIGS. 5A–5C are details of an off road skid and a jack assembly according to one aspect of the invention;

FIG. 9 is a fragmentary detail of an off road plow towing adapter in accordance with an alternative embodiment of the invention;

FIG. 10 is a detail of an alternative embodiment of a connecting rod with an adjustable rod portion.

DESCRIPTION OF THE INVENTION

Figure 1:
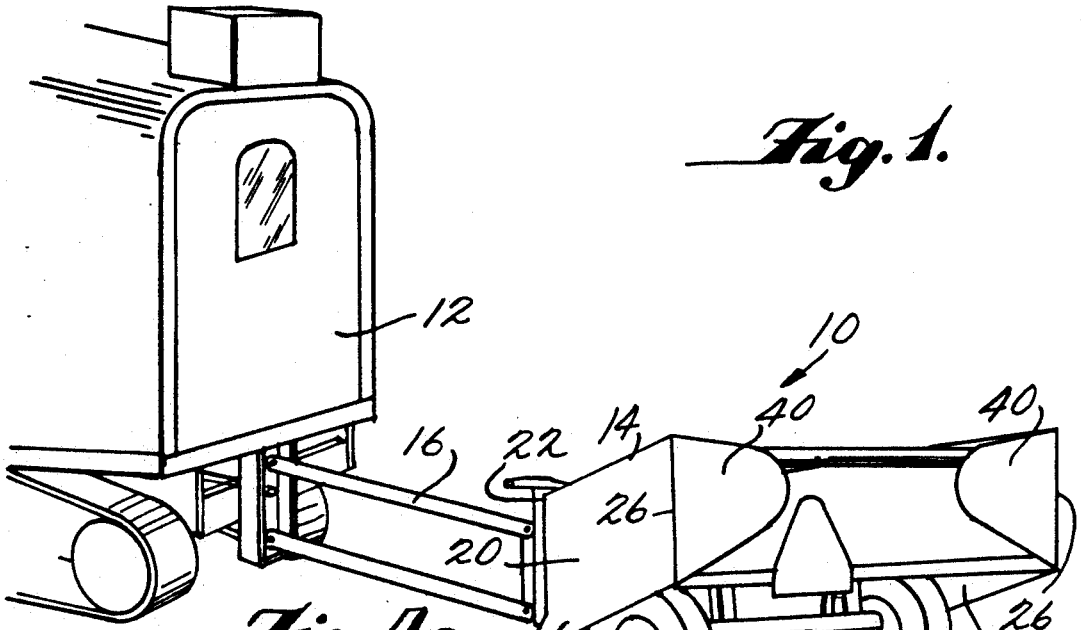
FIG. 1 is an overall schematic view of a trailable snow plow and hitch in accordance with the present invention shown coupled to the rear of a tow vehicle.

FIGS. 1–5C illustrate an embodiment of a trailable plow apparatus 10 according to the invention. As shown in FIG. 1, the apparatus 10 is adapted to be pulled by tow vehicle 12, and includes a plow 14 and a hitch 16.

The plow 14 comprises a pair of plow elements 20 joined together at an apex 22 to form a V shape. Each of the plow elements 20 have a curved skirt portion 24 having leading edges which are adapted to engage the snow cover 25 (FIGS. 2 and 2A).

Figures 2, 5A, 5C:
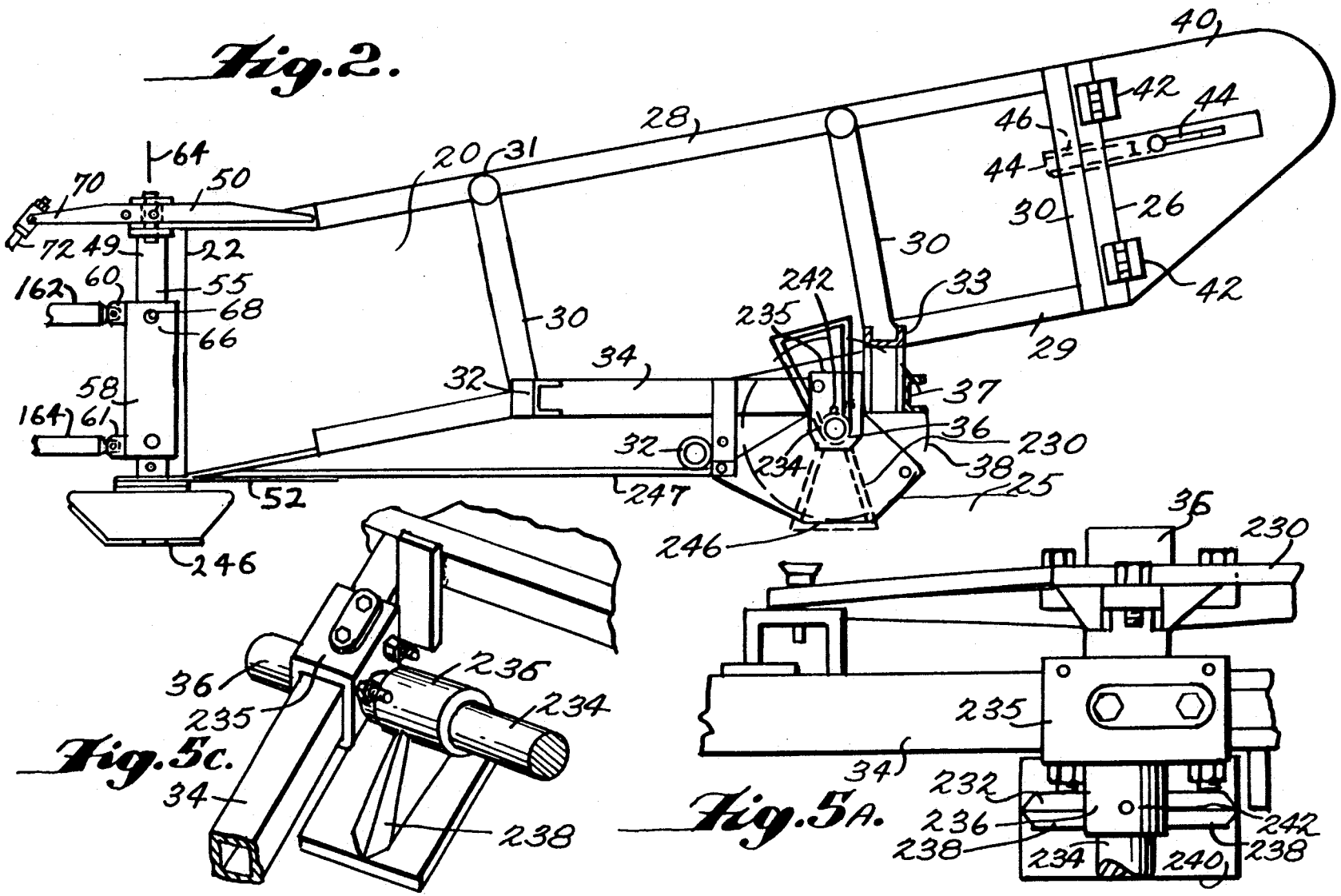
Figure 2A:
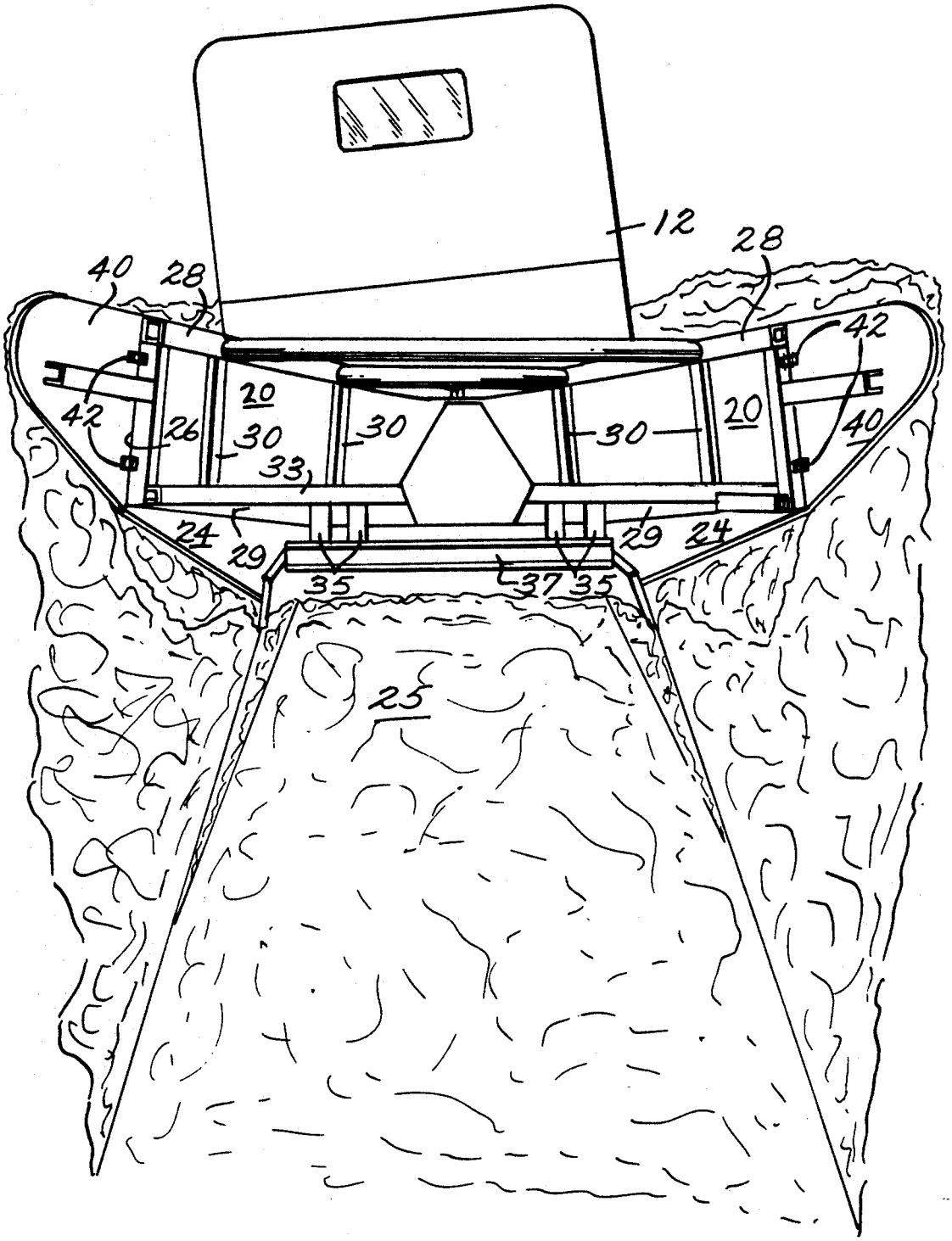
FIG. 2A is a rear view of the "V" plow deployed off the road in snow.

As shown in greater detail in FIG. 2, each plow element 20 extends rearwardly from the apex 22 to terminal ends 26. Upper and lower longitudinal stiffeners 28 and 29 and transverse stiffeners are attached to the rear of the plow elements 20 to form a frame-like support therefor. Upper cross braces 31 are attached to the upper stiffeners 28. Respective forward and rear lower cross members 32 and 33 are attached to the lower stiffeners 29. An axle support 34 is secured between the plow elements 20 near lower, forward cross brace 32 and rear cross brace 33 by means of vertical braces 35 and end brace 37 which is designed to be aligned behind the balance point of the plow 14. Axle 36 extends outwardly of the axle support 34 and carry road engaging wheels 38 which are bolted or secured onto the axles 36, as illustrated, for on road use.

The plow elements 20 may be equipped with hinged trailing wings 40 near the terminal ends 26 thereof. The wings 40 are hinged at 42 and fold inwardly width of the plow for on road use (FIG. 1). As shown in FIG. 2, the wings 40 are deployed in an extended or working position, by means of sliding bolts 44 which are secured to the rear side of the wings 40 and which engage slotted openings 46 in the rearwardly disposed vertical stiffeners 30.

Figure 3:
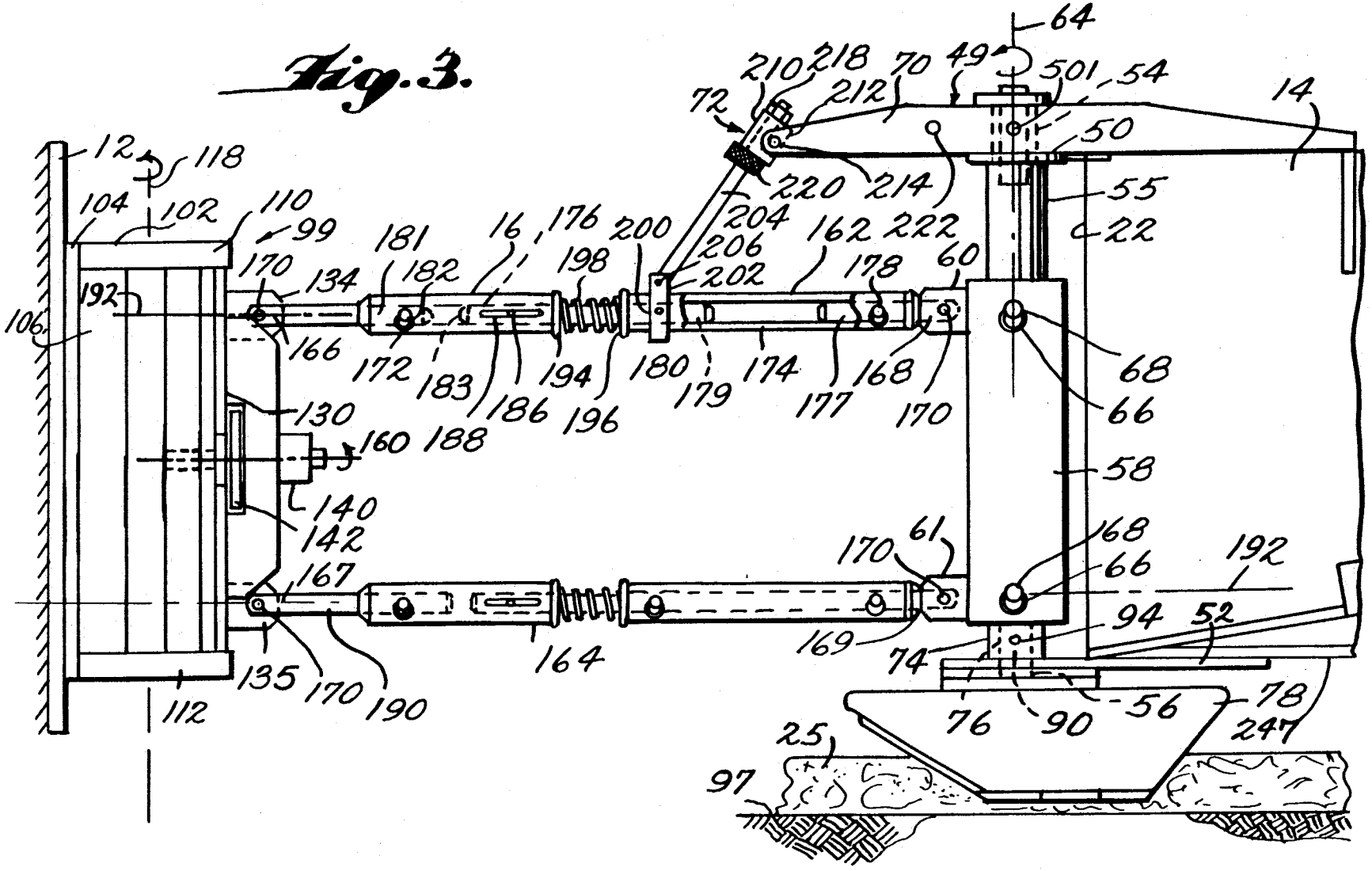
FIG. 3 is an overall side elevation of the hitch assembly illustrated in FIG. 1.

As illustrated in FIGS. 2 and 3, the apex 22 of the plow 14 carries a plow hitch 49 including upper hitch plate 50 and a lower hitch plate 52. A shaft 55 is secured in apertures 54 and 56 in the respective upper and lower hitch plates 50 and 52. The shaft 54 carries a vertically adjustable sleeve 58 which has a pair of spaced apart upper and lower clevis points 60 and 61. The sleeve 58 is adjustable positioned along a generally vertical plow axis 64 by means of pins 66, which pass through aligned apertures 68 in the sleeve 58 and shaft 55. In accordance with the invention, the sleeve 58 and shaft 54 are rotatable together about the plow axis 64. The upper hitch plate 50 has a forward extension arm 70 which carries a lockup mechanism 72 hereinafter described.

The shaft 55 has a lower end 74 which has an axial bore 76 formed therein. A narrow front skid plate 78 has an apertured upwardly extending, vertical boss 90 attached to an upper edge thereof. The boss 90 is secured in the bore 76 of the shaft 54 by means of a shear pin 92 which passes through aligned apertures 94 in the boss 90 and shaft 54.

The front skid plate 78 is adapted to engage the snow cover 25 and slide at or near the ground 97 in an off road configuration. In the event that the skid plate 78 encounters a large obstacle on ground 97, lateral rotational forces imparted to the skid plate 78 may exceed the strength of the structure. Accordingly, the shear pin 94 allows the skid plate 78 to yield in the event that such obstacles are encountered.

Figure 4C:
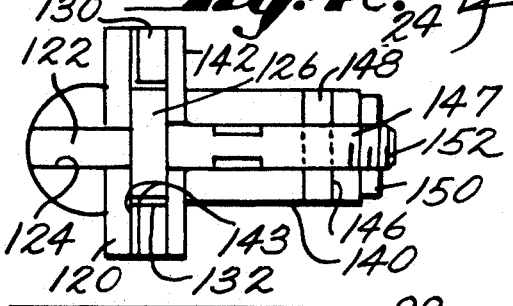
FIGS. 4A–4C are a detailed top, side and sectional views of the vehicle hitch assembly illustrated in FIG. 2.
Figure 4A:
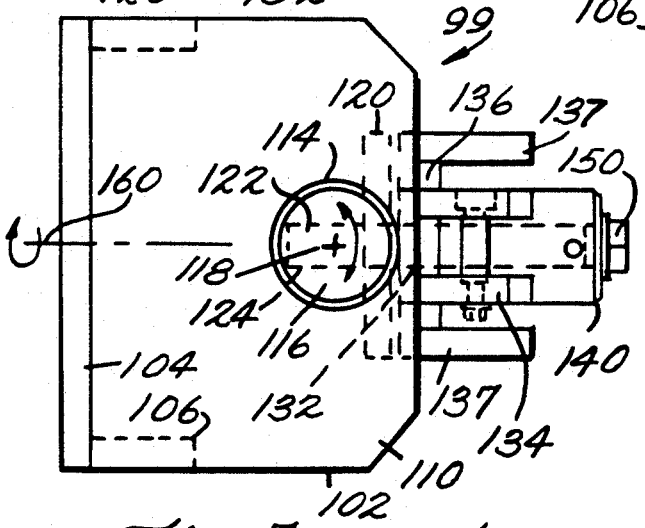
Figure 4B:
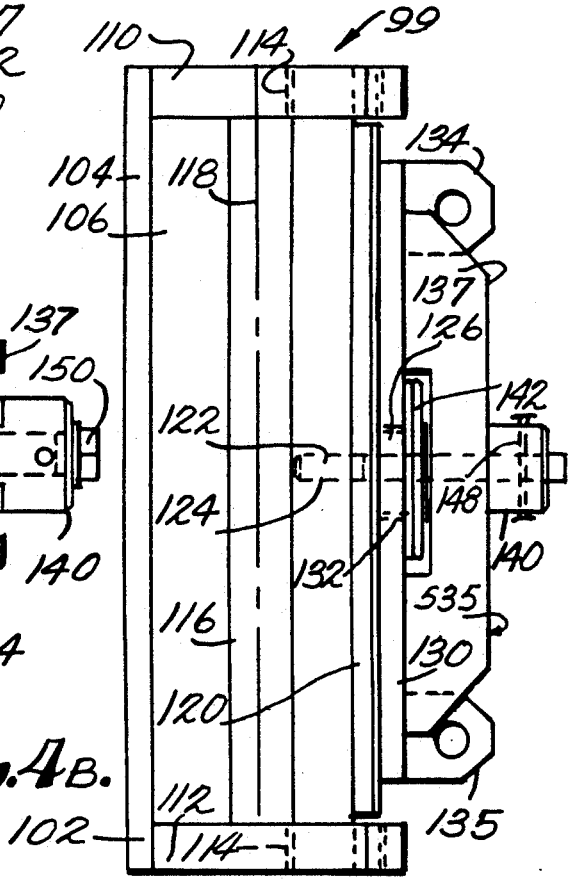

As further illustrated in FIGS. 3 and 4A–4C the hitch mechanism 16 further comprises a vehicle hitch 99 including a vehicle mounted frame 102 having a transverse plate 104 and a pair of side stiffener members 106 extending along lateral margins thereof. Upper and lower shaft supports 110 and 112 are attached to the upper and lower ends of the frame 102. The plates 104 and shaft supports 110 and 112 have aligned apertures 114 which carry a cylindrical shaft 116 therein (FIGS. 4A–4B). The shaft 116 is adapted to rotate about a generally vertical hitch axis 118.

The shaft 116 carries a pivot plate 120 which extends along the shaft 116 between the upper and lower shaft supports 110 and 112. A pivot pin 122 is secured in an aperture 124 which extends through the pivot plate 120 and into the shaft 116. The pivot pin has a spacer 126 in the form of a cylindrical stepped portion. An apertured clevis plate 130, in the form of a rectangular member having an aperture 132 therein is mounted over the pivot spacer 126. Upper and lower clevis points 134 and 135 are secured to the clevis plate 130 near the respective upper and lower ends as illustrated. A pair of side plates 137 are secured to the lateral margins of the clevis plate 130 to stiffen the structure.

The clevis plate 130 is secured to the pivot pin 122 by means of an apertured thrust sleeve 140 and a thrust washer 142 (FIG. 4B). Suitable bearing materials 143 may be provided in interfaces between the pivot plate 120, the spacer 126 and the clevis plate 130. The thrust sleeve 140 and the pivot pin 122 have aligned apertures 146 and 147 for receiving a shear pin 148. An installing nut 150 is secured to a threaded end 152 of the pivot pin 122 for urging the thrust sleeve 140 against the thrust washer 142 so as to provide a bearing force or resistance between the pivot plate 120 and the clevis plate 130. The nut 150 is tightened to a sufficient degree so as to cause the apertures 146 and 147 to move into alignment whereupon the shear pin 148 may be installed. Thereafter the installation nut 150 is removed. When a sufficient rearward force or load is exerted on the clevis points 134 and 136, the shear pin 148 is designed to fail whereupon the clevis plate 130 separates from the pivot plate 120 and slides off the pivot pin 126.

The clevis plate 130 is adapted to rotate about a generally horizontal or common central axis 160 of the pivot pin 122. Likewise, the clevis plate 130 and pivot plate 120 together are adapted to rotate about the hitch axis 118.

As best shown in FIG. 3, the hitch structure 16 further includes a pair of connecting rods or resilently telescopic upper and lower links 162 and 164. In the embodiment illustrated in FIG. 3, the links 162 and 164 are essentially indentical. Each link 162 and 164 includes respective front and rear clevis points 166–167 and 168–169 which are adapted to be secured to the respective clevis points 134, 136 and 60, 61 of the vehicle hitch 99 and the plow hitch 49. The various clevis points noted are interconnected by means of an appropriate bolt or pin 170, as illustrated.

The upper link 162 and the lower link 164 each included front and rear sleeves 172 and 174 which have a central shaft opening 176 therein. A central shaft 177 is secured in the rear sleeve 174 by a quick disconnect pin 178 located in aligned apertures therein. Another central shaft 179 is secured in the opposite end of rear sleeve 174 by a pin 180. A radial key 186 is secured to the front end 183 of shaft 179. A shaft 181 is secured to front sleeve 172 by pin 182. A free end 183 of shaft 179 slides telescopically in central shaft opening 176. The key 186 secured to the free end 183 of shaft 179 rides in a slot 188 in the front sleeve 172 whereby the upper and lower links 162 and 164 may become elongated along their respective generally horizontal link axes 190 and 192. The front and rear sleeves 172 and 174 have corresponding opposing faces 194 and 196 which are in spaced apart relation as illustrated. A spring 198 is sleeved on the central shaft 179 and engages the faces 194 and 196. In the arrangement illustrated, the spring 198 is under compression and is biased to cause front and rear sleeves 172, 174 to move apart as illustrated. If desired, a tension spring could be employed to bias the sleeves 172 and 174 into compression. The length of the slot 188 determines the overall throw or change in length of the links 162 and 164.

The lockup mechanism 72, referred to above and shown in FIG. 3, includes a collar 200 which is adapted to be secured to the upper link 162. The collar 200 has upwardly extending ears 202 which are adapted to be secured to a threaded rod 204 by means of a pin 206 passing through aligned apertures in the ears 202 and the rod 204. The threaded rod 204 is attached to the forward extension arm 70 of the upper hitch plate 50 by means of a sleeve 210. The sleeve 210 has an apertured ear 212 which is secured to the forward extension arm 70 by means of a pin 214 passing through aligned apertures. A locking nut 218 secures the threaded rod 204 in the sleeve 210. An adjustment nut 220 is adapted to allow adjustment between the extension arm 70 and the upper link 162 through the rod 204. The forward extension arm 70 has a aperture 222 near a proximal end thereof as illustrated. When the pin 214 is removed from the extension arm 70, the threaded rod 204 may be rotated about the pin 206 and the mechanism 72 may be secured to the link 162. In on road use, the lockup mechanism 72 is secured to the extension arm 70 and is employed to lift the front of the plow assembly 14 and skid 78 off the ground 97. A pin, located in aperture 222, is removed and inserted in aperture 501 locking the extension arm 70 and rod 55 thus preventing the plow assembly 14 from rotating about axis 64.

Referring again to FIGS. 1-2 and 5A-5C, the plow assembly 14 further includes a pair of removable rear skids 230 which are adapted to be secured on the axles 36 interchangeably with the wheels 38. When off road use is desired, the plow 14 may be jacked up off the ground and the rear skids 230 may be installed on the axles 36 after removal of the wheels 38.

In order to facilitate jacking the plow 14, a pair of retractable jack stands 232 are secured to a jack stand hub or shaft 234 mounted to the plow undercarriage 34 frame by brackets 235 which also carry the axles 36 for the wheels and skids. Jack stands 232 have a pivotable sleeve bearing 236 mounted on the jack stand hub 234 opposite the axle 36 and a pair of radial arms 238 which extend from the bearing 236. An engaging plate 240 joins the free ends of the arms 238 together. The jack stands 232 are rotatable from a storage position in which the engaging plate 240 is retracted to an upwardly facing position shown in solid lines to a lower ground engaging position illustrated in phantom lines (FIG. 2). The jack stands 232 are secured in the storage position by means of a removable locking pin 242 which passes through aligned apertures in the jack stand hub 234 and sleeve bearing 236. When it is desired to raise the plow 14 in order to install the wheels 38 or the rear skids 230, the storage pin 242 is removed and the jack stands 231 are rotated to the ground engaging position while the plow is lifted. The locking pin 242 may be then reinstalled for stability while the wheels 38 and skids 230 ar interchanged. Upon completion of the installation, the jack stands 232 may be returned to the storage position as illustrated.

In accordance with the present invention, the plow assembly 10 of the present invention is effective to provide a suitable path through deep snow leaving relatively thin layer 25, e.g., 2-3 inches of snow cover on the ground 97 after the plow passes. This is accomplished by establishing a 2-3" spacing between the lower edges 246 of the skids 78 and 230 and a lower edge 247 of the plow skirt 24. The skids 78 and 230 are narrow (e.g. $\frac{3}{8}$-$\frac{1}{2}$" wide) so that the plow 14 does not ride above the snow. The skids 78 and 230 ride over the ground 97 while maintaining the lower edge 247 out of engagement with the ground so that it remains relatively undistributed. This is important in permafrost areas where damage to the soil layer can have an adverse environmental impact.

Figure 6A:
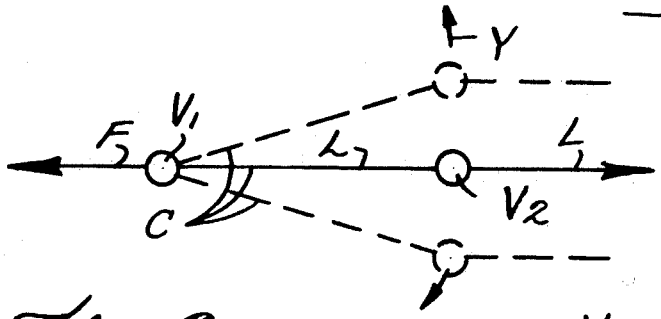
FIGS. 6A–6E schematically illustrate the various degrees of freedom of the apparatus of the present invention.

The skids 78 and 230 also allow the plow 14 to move over obstacles. This is facilitated, to a great extent, by the degrees of freedom afforded by the hitch mechanism 16 as hereinafter described. Reference is directed to FIGS. 6A-6E in which individual degrees of freedom are illustrated. In FIG. 6A, an overhead view, F represents the towing force and L represents the load presented by the plow. $V_1$ represents the hitch vertical axis and V represents the plow vertical axis. C represents a common axes transverse of $V_1$ and $V_2$. Axes are interconnected by the upper and lower links 162 and 164 and are illustrated by the lines interconnecting the axes $V_1$ and $V_2$. As can be appreciated from FIG. 6A, the hitch axis $V_1$ and the plow axis $V_2$ are movable laterally with respect to each other to allow the plow to have a lateral degree of freedom otherwise known as yaw (Y). This allows the plow to easily follow the tractor around corners and to skirt around large obstacles.

Figure 6B:
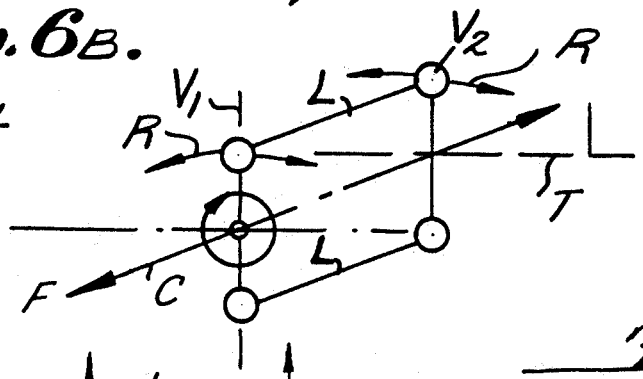

In FIG. 6B, a rotational degree of freedom or roll (R) about the common axis C is illustrated. Roll is provided as a result of the interconnection of the pivot pin 122 and the clevis plate 130 as described above. In the arrangement, the hitch axis $V_1$ and the plow axis $V_2$ roll together by virtue of the interconnection of the upper and lower links L.

Figure 6C:
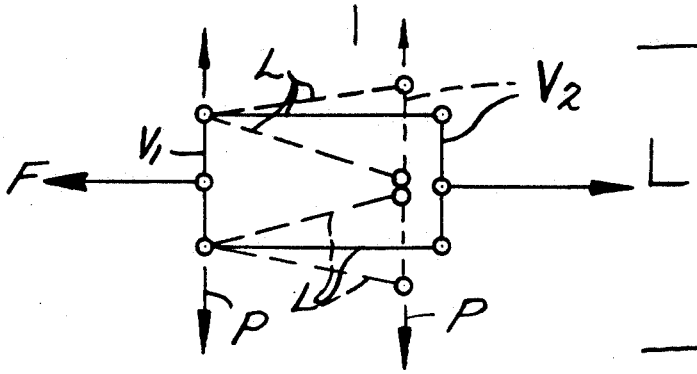

FIG. 6C illustrates an upward and downward degree of freedom or Pitch (P) in which the hitch axis $V_1$ is movable axially in parallel relation with an axial degree job freedom of the plow axis $V_2$. It can be seen in the arrangement that the clevis points, which connect the links to the plow and the hitch, allow the plow to move in a vertical plane with respect to the hitch and towing vehicle while maintaining parallelism. This degree of freedom in the pitch plane (P) occurs when the tow vehicle is vertically displaced relative to the plow as in hilly terrain. Pitch is limited by the parallel nature of the four bar linkage of the hitch design.

Figure 6D:
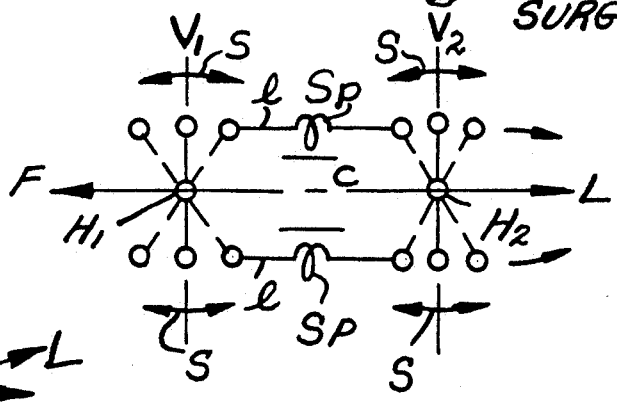

FIG. 6D illustrates a degree of freedom whereby the expandable and retractable nature of the links 1 allows the hitch axis $V_1$ and the plow axis $V_2$ to rotate about respective surge axes $H_1$ and $H_2$. In the arrangement illustrated, the surge axes are horizontal and perpendicular to the common axis C. The degree of freedom or surges illustrated in 6D occurs when the towing force T is initiated or terminated quickly or when the plow traverses rough terrain which causes either the plow or the tow vehicle to pitch in such a way as to cause a twisting force on the restive hitch and plow axes $V_1$ and $V_2$. The springs $S_P$ allow the links to expand and contract in a limited manner as described herein above.

Figure 6E:
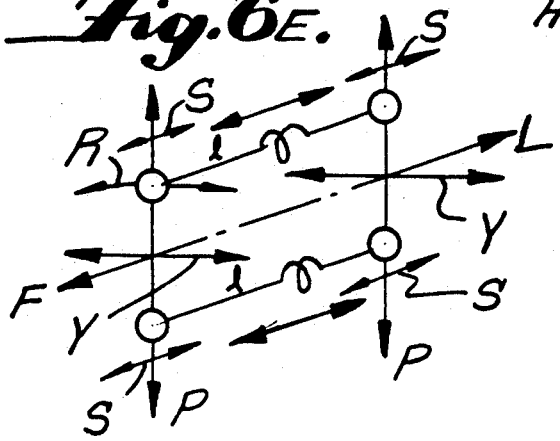

FIG. 6E illustrates all of the degrees of freedom in a composite schematic illustration.

Figure 7:
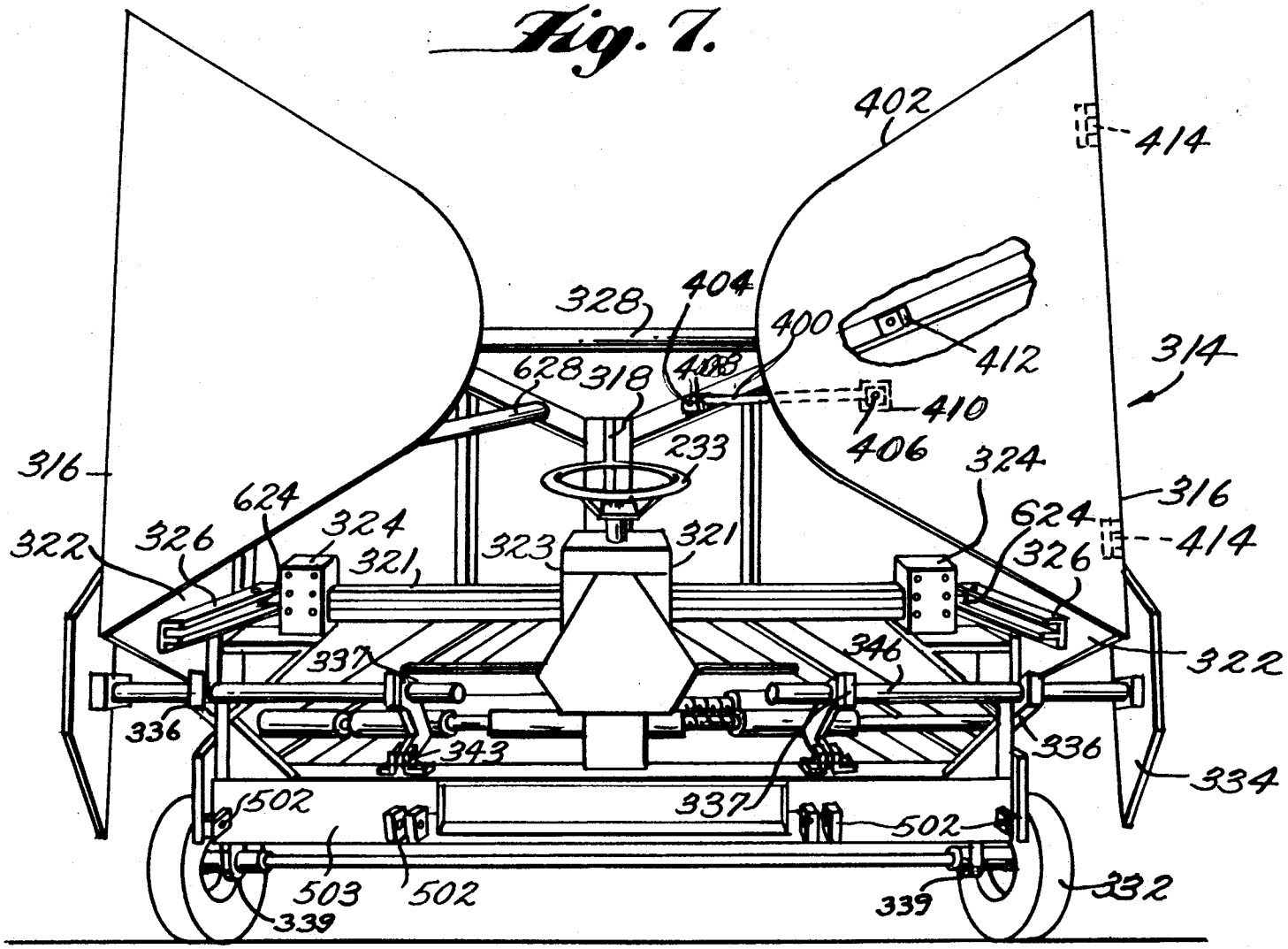
FIG. 7 is a rear view of an alternative embodiment of a retractable V plow having a hinged apex to an adjustable width.

FIGS. 7-10 illustrate details of an alternative embodiment of the present invention. In FIG. 7, an enlarged, heavy duty plow 314 is illustrated from the rear. The plow 314 has plow elements 316 which are secured together at a forward end by a vertical hinge or hinges 318. A plow width adjustment mechanism in the form of a rack and pinion 321 or screw mechanism engage the rear sides 322 of the plow elements 316. The rack and pinion 320 has end portions 624 supported and confined by bearing members 324 which slidable engage track members 326 attached to the rear sides 322 of the plow elements 316. The rack and pinion 321 is adjustable lengthwise by means of a manual transmission 323 actuated by hand wheel 233 between a retracted position illustrated in FIG. 7 and an outwardly extended position whereby the plow elements may be extended to widen the plow 314. As the rack and pinion 320 expands, the free ends 624 slide in the tracks 326. A brace 328 engages various upper margins of the plow elements 316 for stabilizing the structure when the plow is in use. Adjustable brace 628, show in stored position along rear sides 322, is used at the rear of the plow in a similar fashion as brace 328 when the plow is opened for use.

Figures 8, 8A:
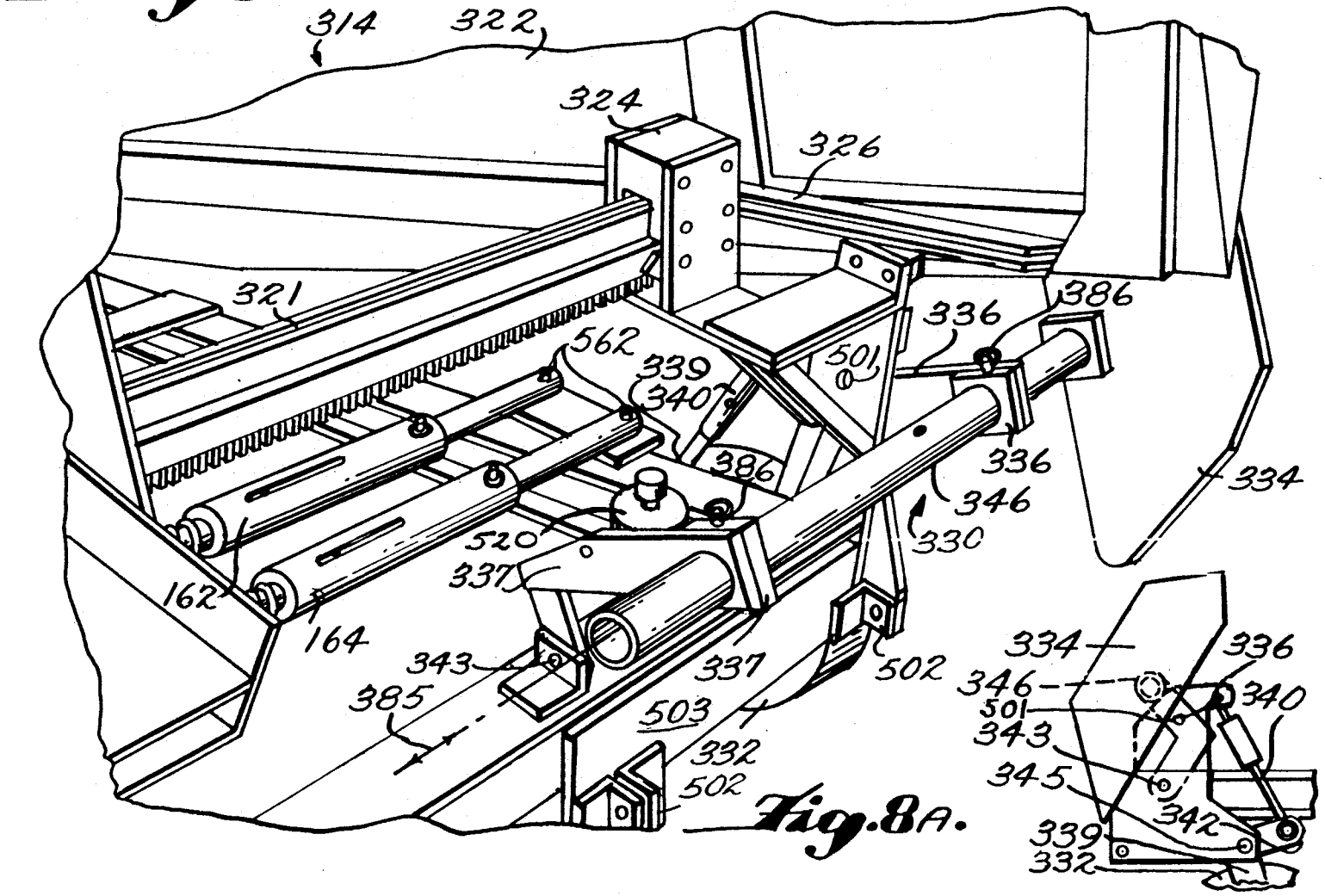
FIG. 8 an illustration in fragmentary rear perspective of an alternative embodiment of a retractable skid and wheel assembly.
FIG. 8A is a schematic illustration of the skid and wheel support of FIG. 8.

In FIG. 8, an alternative embodiment of a retractable rear skid and wheel assembly 330 is illustrated. In the arrangement, the skids 334 are attached to the frame 503 of the plow 314 by a pair of spaced apart skid pivot arms 336 and 337. Each wheel is attached to the plow by wheel pivot arm 339. The wheel 332 is supported in ground engaging relation, as illustrated in FIGS. 7, 8 and 8A, by means of an adjustable jacking brace 340 which engages a radial link 342 extending from the pivot arm 339.

The skid pivot arms 336 and 337 rotate about respective pivots 343; and the wheel 332 and pivot arm 339 rotates about pivot 345. The skids 334 are retractable mounted to skid pivot arms 336 and 337 by a slidable shaft 346 which allows the skids 334 to be adjusted along shaft axis 385 as shown by the arrows. Pin 386 secures the skid 334 in place as shown.

When it is desired to engage the skids 334, the plow assembly 314 may be lifted with the adjustable brace 340, thus lowering the wheels 332. The locking pin 501 is removed whereby each skid 334 may thereafter be rotated about the pivots 343 and 344 into a ground engaging position. Each skid 334 may be locked in position by securing arms 336 and 337 to respective lower locking clevises 502 location on the frame. The wheels are then retracted using adjustable jacking braces 340. The wheels 332 may be relocated for on road use by reversing the procedure and retracting the skid 334. A storable spare wheel 520 for attachment to or in place of the front skid, not shown in FIG. 8, but similar to the skid 78 and FIG. 3 may be provided for maneuvering the plow into and out of storage areas.

As shown in FIG. 9 an alternative on road towing brace 350 may be provided for the front end of the plow 314. Upper and lower plates 354 and 356 support vertical shaft 358. Sleeve 360 is secured to the shaft 358 by pins 362 in a manner herein before described. Triangular brace 364 is attached to sleeve 360 at clevis points 364. A leading end 366 of brace 364 is attached to lower clevis point 368 of trailer hitch 370. Jack screw 372 attached to the brace 364 by means of threaded sleeve 374 may be extended downwardly to raise the plow 314 and front skid 78 off ground 97.

FIG. 10 illustrates a detail of an alternative embodiment of connecting a link 390 in which an adjustable turnbuckle 392 is disposed between a threaded clevis point 394 and an oppositely threaded shaft end 396. In this way, the pitch of the plow 314 with respect to the terrain may be adjusted. Referring to FIGS. 6A-E, the alignment of the axes $V_1$ and $V_2$ may be adjusted relative to each other.

In FIG. 7 an alternative arrangement of a support rod 400 for extendable wing elements 402. In the arrangement illustrated with the wings 402 retracted, the rod has clevis points 404, 410 at the ends which engage corresponding clevis points 408, 406 and on the plow element 316 and the wings 402, respectively. The rod 404 may be detached from clevis point 408 in the plow element 316 and connected to clevis point 412 which is closer to the hinge 414 to thereby deploy the wings 402.

As illustrated in the various drawings, and in particular FIGS. 7 and 8, the various braces, the links and the like may be located in convenient storage positions in which their clevis points are pinned or secured to corresponding clevis points on the frame of the plow for storage when not in use. For instance, links 162 and 164 may be attached to frame 503 by pinning to studs 562.

While there have been described what at present are considered to be the preferred embodiments of the present invention, it will be readily apparent to those skilled in the art that various changes may be made therein without departing from the invention and it is intended in the claims to cover such changes and modifications as fall within the true spirit and scope of the invention

What is claimed is:

1. A hitch apparatus for interconnecting a tow vehicle and a load comprising a four bar linkage including a pair of spaced apart end links each rotatable about a corresponding axis and a pair of interconnecting resilient links coupling the end links together such that the end links and the connecting links form a parallelogram when unstressed, said connecting links being coupled to the end links along axes perpendicular to the longitudinal axes of the corresponding end links and at least one pivot coupled to on of said end links for rotatably securing the four bar linkage between the tow vehicle and the load about a common axis parallel to the interconnecting links and transverse of the end links whereby the hitch apparatus has degrees of freedom in respective yaw and roll directions with limited freedom of relative displacement in the pitch plane.

2. A trailable plow adapted to be towed by a vehicle comprising a plow hitch mountable on the plow and a trailer hitch mountable on the tow vehicle, linkage means for coupling the plow hitch and the trailer hitch for rotatable motion about each of a first pair of spaced apart vertical axes, one of which may be pinned and locked for towing; and means for coupling the plow for rotatable motion about an axis common to the plow hitch and trailer hitch and wherein said linkage means includes resilient means interconnecting the plow hitch and the trailer hitch for yieldably providing a variation in the space between the vertical axes, whereby the plow hitch and trailer hitch have at least two degrees of freedom and one degree of displacement relative to each other.

3. A trailable plow adapted to be towed by a vehicle comprising:

a plow blade;

a plow hitch secured to the plow blade for rotatable movement about a first axis;

a trailer hitch adapted to be secured to the vehicle for rotatable movement about a corresponding hitch axis lying in a plane with said plow axis;

linkage means for coupling the plow hitch and the trailer hitch in the plane for relative axial movement therein;

coupling means for permitting rotatable motion about an axis common to the plow hitch and the trailer hitch and transverse of the plow axis and the hitch axis.

4. The trailable plow of claim 3, wherein the coupling means comprises a clevis.

5. The trailable plow of claim 3, further comprising a plurality of skid plates attached to a lower edge of the plow blade for spacing the plow blade with respect to the ground.

6. The trailable hitch of claim 3, wherein the linkage means comprises a pair of tubular members including sleeve end portions and an interconnecting shaft portion secured in the sleeve end portions.

7. The trailable plow of claim 6, wherein the linkage means further comprise resilient means secured between the sleeve end portions for biasing the sleeve end portions with respect to the shaft portion.

8. The trailable plow of claim 7, wherein the linkage means further comprises a slidable key interconnecting at least one of the sleeve end portions and the shaft for providing relative movement therebetween over a selected distance.

9. The trailable plow of claim 3, wherein said linkage means comprises a pivot pin shearably secured to the hitch axis.

10. The trailable plow of claim 3, further including a first joint between the trailer hitch and the plow hitch for allowing rotational movement along an axis transverse of the hitch axis and the plow axis and common thereto.

11. The trailable plow of claim 3, wherein the hitch axis and the plow axis comprise a pair of shaft members disposed in parallel configuration when the interconnecting links are unstressed, said shafts being movable along their respective longitudinal axes in a common plane including the common axis interconnecting said longitudinal axes.

12. The trailable plow of claim 3, further including wheel support means for rollably supporting the plow along a roadway or during plowing.

13. The trailable plow of claim 3, further including storable skid plate means interchangeable with the wheels for supporting the plow on terrain removed from the roadway.

14. The trailable plow of claim 13, further comprising means for securing the plow hitch and the trailer hitch in longitudinally fixed relation in the plane.

15. The trailable plow of claim 3, further including storage means for securing the skid plates to the plow out of engagement with the roadway.

16. The trailable plow of claim 3, further including rotatable jack stand means secured to the plow and rotatable for engaging the ground and spacing the wheels and the skid plates away from the ground to thereby permit the interchange thereof.

17. The trailable plow of claim 3, further comprising retractable end portions of said plow elements including hinged wing members rotatably secured to the plow elements and rotatable inwardly thereof for storage.

18. The trailable plow of claim 17 further comprising means for locking the rotatable end portions with respect to the plow element.

19. The trailable plow of claim 18, wherein the means for supporting the plow elements comprises a rack and pinion of screw engaging rearward sides of the plow elements.

20. The trailable plow of claim 19, further comprising slider means attached to the plow elements and engaging corresponding ends of the rack and pinion for slidable interconnecting the plow elements with said rack and pinion.

21. The trailable plow of claim 3, wherein the plow blade comprises a pair of opposed plow elements being joined together at an apex in a forward direction.

22. The trailable plow of claim 21, further comprising a hinge interconnecting the plow elements at the apex.

23. The trailable plow of claim 22, further comprising means interconnecting the plow elements between extended and retracted positions.

24. The trailable plow of claim 3, further comprising wheel and skid assemblies mounted transversely of the plow, including a pair of wheels and a pair of skids, pivotally secured to the plow, one assembly for carrying two wheels, two assemblies for carrying and corresponding skids at opposite ends thereof, said wheel and skid assembly rotatable about pivots for selectively engaging the wheel or the skid into a ground engaging position.

* * * * *